US011373826B2

(12) United States Patent
Namikawa

(10) Patent No.: US 11,373,826 B2
(45) Date of Patent: Jun. 28, 2022

(54) BREAKER AND SAFETY CIRCUIT EQUIPPED WITH THE SAME

(71) Applicant: BOURNS KK, Osaka (JP)

(72) Inventor: Masashi Namikawa, Osaka (JP)

(73) Assignee: Bourns KK, Osaka (JP)

( * ) Notice: Subject to any disclaimer, the term of this patent is extended or adjusted under 35 U.S.C. 154(b) by 0 days.

(21) Appl. No.: 16/772,710

(22) PCT Filed: Dec. 18, 2018

(86) PCT No.: PCT/JP2018/046473
§ 371 (c)(1),
(2) Date: Jun. 12, 2020

(87) PCT Pub. No.: WO2019/124338
PCT Pub. Date: Jun. 27, 2019

(65) Prior Publication Data

US 2020/0321176 A1 Oct. 8, 2020

(30) Foreign Application Priority Data

Dec. 21, 2017 (JP) ..... JP2017-245524

(51) Int. Cl.
*H01H 37/04* (2006.01)
*H01H 37/34* (2006.01)
*H01H 37/54* (2006.01)

(52) U.S. Cl.
CPC ..... *H01H 37/04* (2013.01); *H01H 37/34* (2013.01); *H01H 37/5427* (2013.01)

(58) Field of Classification Search
CPC .... H01H 37/04; H01H 37/34; H01H 37/5427; H01H 37/32; H01H 37/54
(Continued)

(56) References Cited

U.S. PATENT DOCUMENTS 9,831,054 B2 11/2017 Chen et al.
2013/0323547 A1 12/2013 Namikawa
(Continued)

FOREIGN PATENT DOCUMENTS

JP 2004220944 A 8/2004
JP 2014154518 A * 8/2014
(Continued)

OTHER PUBLICATIONS

Namikawa Katsufumi, "Breaker and Safety Circuit Including the Same and Secondary Battery Circuit" Aug. 25, 2014, Komatsulite MFG Co. LTD, Entire Document (Translation of JP 2014154518). (Year: 2014).*

(Continued)

*Primary Examiner* — Stephen S Sul
(74) *Attorney, Agent, or Firm* — Knobbe Martens Olson & Bear LLP

(57) ABSTRACT

A breaker comprises: a fixed piece having a fixed contact; a movable piece having a movable contact and pressing the movable contact against the fixed contact to contact therewith; a thermally-actuated element for shifting the movable piece from a conduction state in which the movable contact contacts with the fixed contact to a turn-off state; a PCT thermistor; and a resin case. The fixed piece has a contacting portion contacting with the PCT thermistor. The resin case has a bottom surface provided with a concave portion. In a planar view when the fixed piece is viewed from the PCT thermistor, the contacting portion is disposed within the concave portion. The concave portion has a bottom recessed from the bottom surface of the resin case to prevent the bottom from protruding outwardly from the bottom surface when the thermally-actuated element is deformed.

20 Claims, 7 Drawing Sheets

(58) Field of Classification Search
USPC ..... 337/89, 91, 100–103
See application file for complete search history.

(56) References Cited

U.S. PATENT DOCUMENTS

| | | | | |
|---|---|---|---|---|
| 2014/0285308 | A1* | 9/2014 | Namikawa | H01H 37/04 337/1 |
| 2015/0035641 | A1* | 2/2015 | Mochizuki | H01H 69/02 337/35 |
| 2016/0035521 | A1* | 2/2016 | Namikawa | H01H 37/5427 337/380 |
| 2016/0035522 | A1* | 2/2016 | Namikawa | H01H 37/52 337/362 |
| 2016/0086753 | A1* | 3/2016 | Mochizuki | H01H 37/52 337/380 |
| 2017/0062167 | A1* | 3/2017 | Tanaka | H01H 37/52 |

FOREIGN PATENT DOCUMENTS

| | | |
|---|---|---|
| JP | 2014-235913 | 12/2014 |
| JP | 2016-031917 | 3/2016 |
| JP | 2016-062729 | 4/2016 |
| JP | 2016-225142 | 12/2016 |

OTHER PUBLICATIONS

International Search Report dated Mar. 19, 2019, in International Application No. PCT/JP2018/04, 2 pages.

* cited by examiner (a) Prior Art (b) Prior Art

BREAKER AND SAFETY CIRCUIT EQUIPPED WITH THE SAME

TECHNICAL FIELD

The present invention relates to a minisize circuit breaker to be built into a secondary battery pack or the like of an electrical equipment.

BACKGROUND ART

Conventionally, a breaker has been used as a protection device (safety circuit) for a secondary battery, a motor and the like of various electrical equipments.

when an abnormality occurs, e.g. when the temperature of a secondary battery during charging/discharging rises excessively, or when an overcurrent flows through a motor or the like installed in an equipment of an automobile, a home appliance or the like, the breaker cuts off the current to protect the secondary battery, motor and the like.

The breaker used as such a protection device is required to operate accurately (to have good temperature characteristics) in accordance with temperature changes in order to ensure the safety of the equipment as well as to have a stable resistance value when the current flows through.

The breaker is provided with a thermally-actuated element which, according to the temperature change, operates to turn on or turn off the current.

Patent Document 1 discloses a breaker using a bimetal as a thermally-actuated element. A bimetal is an element, which is formed by laminating two types of plate-like metal materials having different coefficients of thermal expansion, and which changes its shape according to the temperature change to control the conduction state of the contacts.

The breaker disclosed in this document is formed by housing in its case, a fixed piece, a terminal piece, a movable piece, a thermally-actuated element, a PTC thermistor and the like. And terminals of the fixed piece and terminal piece protrude from the case to be connected to an electric circuit of an equipment in order to use the breaker.

PRIOR ART DOCUMENT

Patent Document

Patent Document 1: Japanese Patent Application Publication No. 2016-62729

SUMMARY OF THE INVENTION

Problem to be Solved by the Invention

On the other hand, when a breaker is used as a protection device for a secondary battery provided in an electrical equipment, e.g. a notebook size personal computer, a tablet type portable information terminal device, a thin multifunctional mobile phone called smartphone and the like, miniaturization is required for the breaker in addition to the safety as described above.

In recent years, users have a strong desire for miniaturization (thinness) of portable information terminal devices, therefore, devices newly launched on the market by various manufacturers have a pronounced tendency to be designed to be small in order to ensure superiority in the design. Against this background, a breaker which is mounted together with a secondary battery as a component of a portable information terminal device is also strongly required to be further miniaturized.

FIG. 8 shows a breaker 100 having a structure equivalent to that of the breaker disclosed in Patent Document 1.

In this figure, (a) is a sectional view of the breaker 100 when exposed to a high temperature environment, and (b) is a cross-sectional view of the breaker 100 thereafter cooled under a thermally neutral environment.

As shown in FIG. 8 (*a*), by the heat of the high-temperature environment, a thermally-actuated element 5 is deformed and reversely warps to press the PTC thermistor 6 toward a bottom of a resin case main body 7, and thereby, a support part 26 of the fixed piece 2 and a bottom wall 75 of the case main body 7 are expanded outwardly. At this time, the bottom wall 75 of the case main body 7 has been softened by the increased temperature, and thus makes plastic deformation.

As shown in FIG. 8 (*b*), such bottom wall 75 maintains its expanded shape even after being cooled down. Thereby, the thickness dimension of the circuit breaker 100 is increased, which hinders the thinning of an electrical equipment.

Further, in recent years, aiming to improve production efficiency, it has been considered to directly mount a breaker on a circuit board, and also to use soldering reflow for connecting terminals of the breaker with leads of the circuit board.

In such a reflow process, since the breaker 100 is exposed to a high temperature environment, the above described expansion of the bottom wall 75 becomes remarkable.

In particular, the above described expansion of the bottom wall 75 easily occurs when the thickness of the bottom wall 75 of the breaker 100 is small, therefore, it is difficult to achieve further thinning of the electric equipment.

In order to solve the above problems, the present invention was made, and it is an object of the present invention to provide a breaker which can be easily miniaturized by suppressing the expansion of its case caused by the temperature rise.

Means of Solving the Problems

According to the present invention, in order to achieve the above object, a breaker which comprises a fixed piece having a fixed contact, a movable piece having a movable contact and pressing the movable contact against the fixed contact to contact therewith, a thermally-actuated element deforming with a change in the temperature so as to shift the movable piece from a conduction state in which the movable contact contacts with the fixed contact to a turn-off state in which the movable contact is separated from the fixed contact, a positive temperature coefficient thermistor providing an electrical conduction between the movable piece and the fixed piece when the movable piece is in the above-said turn-off state, and a resin case accommodating the fixed piece, the movable piece, the thermally-actuated element, and the positive temperature coefficient thermistor, is characterized in that the fixed piece has a contacting portion contacting with the positive temperature coefficient thermistor, the resin case has its bottom surface and a concave portion which is recessed from the bottom surface toward the positive temperature coefficient thermistor across the fixed piece, and in a planar view when the fixed piece is viewed from the positive temperature coefficient thermistor, the above-said contacting portion is disposed within the concave portion.

In the breaker according to the present invention, it is desirable that, in the above-said planar view, the whole of the positive temperature coefficient thermistor is disposed within the concave portion.

In the breaker according to the present invention, it is desirable that the fixed piece is exposed from the concave portion.

In the breaker according to the present invention, it is desirable that the fixed piece has a terminal which is exposed from the bottom surface to be connected to an external circuit.

In the breaker according to the present invention, it is desirable that the concave portion is formed in a rectangular shape which has a corner portion positioned in a region facing the above-said terminal, and the corner portion is formed in an arc shape which is convex toward the terminal.

A safety circuit for an electrical equipment according to the present invention is characterized by having the breaker.

Effects of the Invention

In the breaker according to the present invention, the fixed piece has the contacting portion which contacts with the PTC thermistor, and the resin case has the bottom surface, and the concave portion which is recessed from the bottom surface toward the PTC thermistor across the fixed piece.

Then, the contact portion is disposed within the concave portion in the planar view when the fixed piece is viewed from PTC thermistor.

Therefore, even when the breaker according to the present invention is exposed to a high temperature environment, and the positive temperature coefficient thermistor is pressed toward the bottom of the resin case by the reversely-warped thermally actuated element, the fixed pieces and the resin case expand outwardly in a portion where the contact portion is provided, namely, in the concave portion which is recessed in advance. Thus, the increase in the thickness of the resin case thus that of the breaker as a whole can be suppressed, and it becomes possible to easily achieve the miniaturization.

Moreover, the effect to suppress the expansion of the case is remarkably effectual in a reflow process by which the breaker is exposed to high temperatures. Thereby, in the reflow process, the posture of the breaker relative to the circuit board becomes stable, and the contact state between terminals of the breaker and lands of a circuit board becomes stable, therefore, easily good soldering is possible.

MODE FOR CARRYING OUT THE INVENTION

Figure 1:
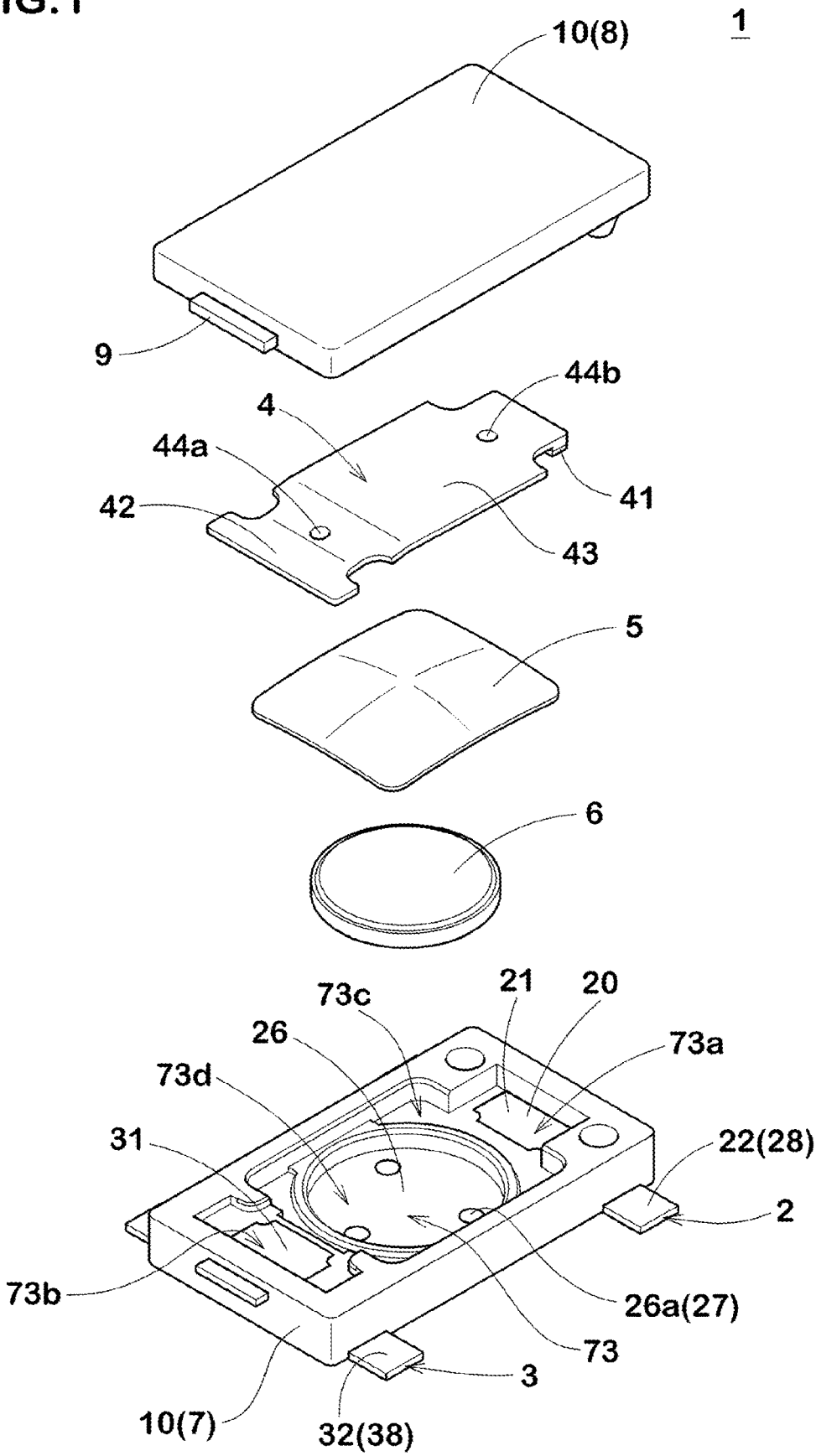
FIG. 1 A perspective view of a breaker according to an embodiment of the present invention showing its general structure before assembled.
Figure 2:
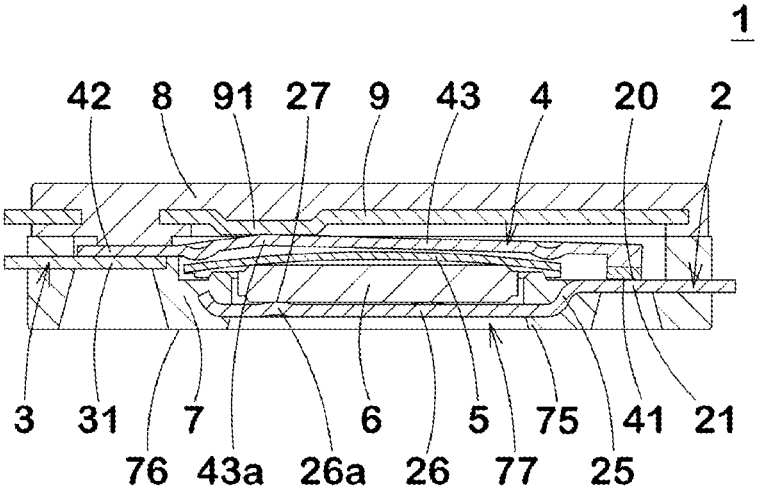
FIG. 2 A cross sectional view showing the breaker in a normal charge and discharge state.
Figure 3:
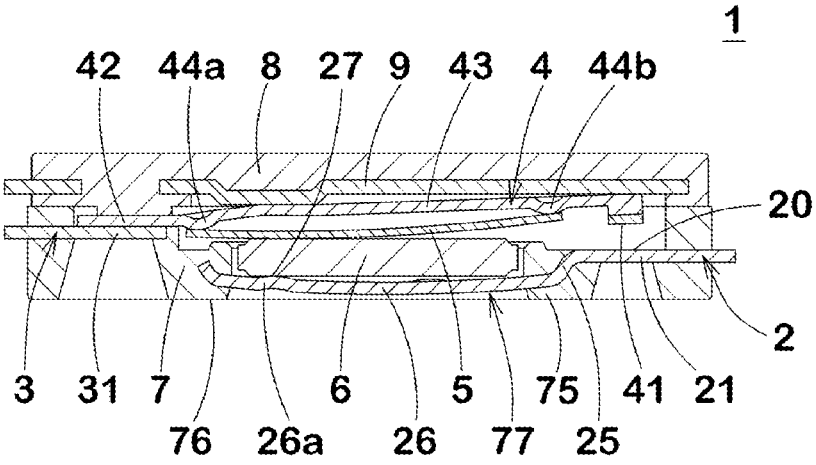
FIG. 3 A cross sectional view showing the breaker at the time of an overcharge state, an abnormality, etc.

A breaker according to an embodiment of the present invention will be described with reference to the drawings. FIG. 1 to FIG. 3 show a structure of the breaker.

The breaker 1 comprises a fixed piece 2 and a terminal piece 3 partially exposed to the outside of a case 10.

By electrically connecting the exposed portions of the fixed piece 2 and the terminal piece 3 to an external circuit (not shown), the breaker 1 constitutes a main part of a safety circuit of an electrical equipment.

As shown in FIG. 1, the breaker 1 is composed of a fixed piece 2 which has a fixed contact 20 and a terminal 22, a terminal piece 3 which has a terminal 32, a movable piece 4 which has a movable contact 41 in its distal end portion, a thermally-actuated element 5 which changes its shape according to the temperature change, a PTC (Positive Temperature coefficient) thermistor 6, a case 10 which accommodate the fixed pieces 2, the terminal piece 3, the movable piece 4, the thermally-actuated element 5, the PTC thermistor 6 and the like.

The case 10 is composed of a case main body (first case) 7, a lid member (second case) 8 attached to an upper surface of the case main body 7, and the like.

The fixed piece 2 is formed by pressing a metal plate, for example, made mainly of copper (aside therefrom, metal plates of a copper-titanium alloy, a nickel silver, a brass and the like), and it is embedded in the case main body 7 through an insert molding process.

The fixed contact 20 is formed from a good conductor material, e.g. silver, nickel, nickel-silver alloy as well as copper-silver alloy, gold-silver alloy and the like through a technique of cladding, plating, coating or the like.

The fixed contact 20 is formed in a contact portion 21 opposed to the movable contact 41, and is exposed to an accommodating recess 73 of the case main body 7 through a portion of an opening 73*a* formed in the inside of the case main body 7.

In the present application, unless otherwise noted, the description is made on the premise that, of the fixed piece 2, the surface on the side on which the fixed contact 20 is formed (namely, a surface on the upper side in FIG. 1) is called as a first surface, and the bottom surface on the opposite side thereto as a second surface. The same applies to other components, e.g. the terminal piece 3, the movable piece 4, the thermally-actuated element 5, the case 10, the metal plate 9 and the like.

As shown in FIG. 2, the fixed piece 2 has a steppedly bent portion 25 bent in the form of a step (a crank shape when viewed from its side), and a support portion 26 supporting the PTC thermistor 6.

The steppedly bent portion 25 connects between the fixed contact 20 and the support portion 26, and arranges the fixed contact 20 and the support portion 26 at different heights.

The steppedly bent portion 25 is embedded in the case main body 7.

The PTC thermistor 6 is placed on convex projections (DABO) 26*a* formed at three positions on the support portion 26, and it is supported by the projections 26*a*.

Similarly to the fixed piece 2, the terminal piece 3 is formed by pressing a metal plate made mainly of copper or the like, and embedded in the case main body 7 through an insert molding process.

The terminal piece 3 has a terminal 32, and a connecting portion 31 connected to the movable piece 4.

The connecting portion 31 is exposed to the accommodating recess 73 of the case main body 7 through a portion of an opening 73*b* formed in the inside of the case main body 7, and electrically connected to the movable piece 4.

The movable piece 4 is formed by pressing a plate-like metal material made mainly of copper or the like.

The movable piece 4 is formed in the form of an arm which is symmetrical about its longitudinal centerline.

The movable contact 41 is formed in one of end portions of the movable piece 4.

The movable contact 41 is formed, on the second surface of the movable piece 4, from a material equivalent to the fixed contact 20, and joined to the end portion of the movable piece 4 through a technique such as welding as well as cladding, caulking (crimping) and the like.

In the other of the end portions of the movable piece 4, there is formed a connecting portion 42 electrically connected to the connecting portion 31 of the terminal piece 3.

The first surface of the connecting portion 31 of the terminal piece 3 is fixed to the second surface of the connecting portion 42 of the movable piece 4 through laser welding.

The laser welding is a welding method for joining workpieces together by locally melting and solidifying the workpieces by irradiating a laser light to the workpieces (corresponding to the terminal piece 3 and the movable piece 4 in this embodiment). On the surface of the workpiece to which the laser beam is irradiated, there is formed a laser welding mark different from welding marks caused by other welding techniques (e.g., resistance welding utilizing Joule heat).

The movable piece 4 has an elastic portion 43 between the connecting portion 42 and the movable contact 41.

The elastic portion 43 is extended from the connecting portion 42 toward the movable contact 41. Thus, the connecting portion 42 is provided on the opposite side to the movable contact 41 across the elastic portion 43.

By fixing the connecting portion 42 to the connecting portion 31 of the terminal piece 3, the movable piece 4 is fixed. And when the elastic portion 43 is elastically deformed, the movable contact 41 formed on the tip thereof is pressed toward the fixed contact 20 and contacts therewith. Thus, the fixed piece 2 and the movable piece 4 become a state in which current can flow.

Since the movable piece 4 and the terminal piece 3 are electrically connected at the connecting portion 31 and the connection portion 42, the fixed piece 2 and the terminal piece 3 become a state in which current can flow.

The movable piece 4 is curved or bent in the elastic portion 43 by press working.

The degree of curvature or bend is not particularly limited as long as it is possible to hold the thermally-actuated element 5, and it may be appropriately set in consideration of the elastic force at the operating temperature and reset temperature, the force pressing the contact, and the like.

On the second surface of the elastic portion 43, a pair of projections (contact portions) 44*a*, 44*b* is formed oppositely to the thermally-actuated element 5.

The projections 44*a*, 44*b* contact with the thermally-actuated element 5. And through the projections 44*a*, 44*b*, the deformation of the thermally-actuated element 5 is transmitted to the elastic portion 43 (see FIGS. 1 and 3).

The thermally-actuated element 5 shifts the conduction state in which the movable contact 41 contacts with the fixed contact 20 to the turn-off state in which the movable contact 41 separates from the fixed contact 20.

The thermally-actuated element 5 is formed by laminating sheet materials having different thermal expansion rates, and it has an initial shape curved in an arc manner.

The curved shape of the thermally-actuated element 5 is reversely warped with a snap motion when it reaches an operating temperature by overheating, and is reset when it becomes below the reset temperature by cooling.

The initial shape of the thermally-actuated element 5 can be provided through a press working.

The material and shape of the thermally-actuated element 5 are not particularly limited as long as the elastic portion 43 of the movable piece 4 is pushed up at the desired temperature owing to the reversely warping motion of the thermally-actuated element 5, and returns to the original by the elastic force of the elastic portion 43. But, a rectangular shape is desirable in view of the productivity and the efficiency of the reversely warping motion. Further, a rectangular shape close to a square is desirable in order to push up the elastic portion 43 effectively while being compact.

As the materials of the thermally-actuated element 5, two kinds of materials having different thermal expansion rates such as various alloys of nickel silver, brass, stainless steel and the like are used by being combined and laminated according to the required conditions.

As to materials of the thermally-actuated element 5 by which for example a stable operating temperature and reset temperature can be obtained, preferred is a combination of a copper-nickel-manganese alloy as the high expansion rate side, and an iron-nickel alloy as the low expansion rate side. Further, materials which are more desirable from the viewpoint of chemical stability, include an combination of an iron-nickel-chromium alloy as the high expansion rate side and an iron-nickel alloy as the low expansion rate side.

Furthermore, materials which are more desirable from the viewpoint of chemical stability and processability, include an combination of an combination of an iron-nickel-chromium alloy as the high expansion rate side and an iron-nickel-cobalt alloy as the low expansion rate side.

When the movable piece 4 is in the turn-off state, the PTC thermistor 6 provides an electrical conduction between the fixed piece 2 and the movable piece 4.

The PTC thermistor 6 is disposed between the support portion 26 of the fixed piece 2 and the thermally-actuated element 5. That is, the support portion 26 is located just beneath the thermally-actuated element 5 through the PTC thermistor 6 therebetween.

When the current between of the fixed piece 2 and the movable member 4 is turned off by the reversely warping motion of the thermally-actuated element 5, this increases the current flowing through the PTC thermistor 6.

As long as the PTC thermistor 6 is a positive temperature coefficient thermistor which can limits its current by its resistance increasing with the temperature rise, its type can be arbitrary selected according to the requirements such as the operating current, operating voltage, operating temperature, and reset temperature. And its material and shape are not particularly limited as long as they do not impair these characteristics.

In the present embodiment, there is used a ceramic sintered body which contains barium titanate, strontium titanate or calcium titanate. Aside from the ceramic sintered body, so-called polymer PTC in which conductive particles such as carbon are dispersed in a polymer may be used.

The case 10 is formed in a rectangular shape whose long sides lie in the long direction of the elastic portion 43 (i.e., the direction from the connecting portion 42 to the movable contact) when viewed in the thickness direction of the elastic portion 43 of the movable piece 4.

The case main body 7 and lid member 8 constituting the case 10 are molded from thermoplastic resins, e.g. flame retardant polyamide, polyphenylene sulfide (PPS) having excellent heat resistance, liquid crystal polymer (LCP), polybutylene terephthalate (PBT) and the like.

It may be possible to employ materials other than resins if properties compatible or higher than the above-mentioned resins can be obtained.

The case main body 7 is provided with the accommodating recess 73 which is an internal space accommodating the movable piece 4, the thermally-actuated element 5, the PTC thermistor 6 and the like.

The accommodating recess 73 has the openings 73*a*, 73*b* for receiving the movable piece 4, the opening 73*c* for receiving the movable piece 4 and the thermally-actuated element 5, an opening 73*d* for receiving the PTC thermistor 6, and the like.

The movable piece 4 and the thermally-actuated element 5 which are mounted in the case main body 7 have their edges which are respectively contacted by frames formed inside the accommodating recess 73 and which are guided when the thermally-actuated element 5 is making the reversely warping motion.

In the lid member 8, a metal plate 9 is embedded by insert molding.

The metal plate 9 is formed by press working on the above-mentioned metal plate containing copper as the main component or a metal plate of a stainless steel or the like.

The metal plate 9 timely contacts with the first surface of the movable piece 4 as shown in FIGS. 2 and 3 in order to restrict the movement of the movable piece 4, and increases the rigidity and strength of the lid member 8 and consequently of the case 10, contributing to the miniaturization of the breaker 1.

As shown in FIG. 1, the lid member 8 is attached to the case main body 7 so as to close the openings 73*a*, 73*b*, 73*c*, etc. of the case main body 7 accommodating the fixed piece 2, the terminal piece 3, the movable piece 4, the thermally-actuated element 5, the PTC thermistor 6 and the like.

The case main body 7 and the lid member 8 are joined by ultrasonic welding, for example. In this case, the case main body 7 and the lid member 8 are joined continuously over the entire circumference of each of the outer edges of the case main body and the lid member, so the airtightness of the case 10 is improved. Thereby, the internal space of the case 10 resulting from the accommodating recess 73 is sealed, and the components such as the movable piece 4, the thermally-actuated element 5 and the PTC thermistor 6 are shut off from the external atmosphere of the case 10 and can be protected. In the present embodiment, the resin is wholly disposed on the first surface side of the metal plate 9, therefore, the airtightness of the accommodating recess 73 is further improved.

FIG. 2 shows the operation of the breaker 1 in the normal charge and discharge state. In the normal charge and discharge state, the thermally-actuated element 5 maintains its initial shape (before reversely warping).

The metal plate 9 is provided with a protrusion 91 which contacts with a top portion 43*a* of the movable piece 4 and which presses the top portion 43*a* toward the thermally-actuated element 5.

By pressing the top portion 43*a* with the protrusion 91, the elastic portion 43 is elastically deformed, and the movable contact 41 formed at the tip end of the elastic portion 43 is pushed toward the fixed contact 20 and contacts therewith. Thereby, the breaker 1 is conductive between the fixed piece 2 and the terminal piece 3 through the elastic portion 43 of the movable piece 4.

It is possible that, as a result of a contact between the elastic portion 43 of the movable piece 4 and the thermally-actuated element 5, the movable piece 4, the thermally-actuated element 5, the PTC thermistor 6 and the fixed piece 2 are continued as a circuit. However, the current flowing through the PTC thermistor 6 is substantially negligible as compared to the amount flowing through the fixed contact 20 and the movable contact 41 since the resistance of the PTC thermistor 6 is very high as compared with the resistance of the movable piece 4.

FIG. 3 shows the operation of the breaker 1 under an overcharge condition, an abnormal state and the like.

When becoming a high temperature state by overcharge or abnormality, the thermally-actuated element 5 reached to the operating temperature warps reversely, and the elastic portion 43 of the movable piece 4 is pushed up. Thereby, the fixed contact 20 and the movable contact 41 are separated from each other.

The operating temperature of the thermally-actuated element 5 at which the thermally-actuated element 5 is deformed in the inside of the breaker 1 and pushes up the movable piece 4, is from 70 to 90 degrees C., for example.

At this time, the current flowing between the fixed contact 20 and the movable contact 41 is cut off, and a slight leakage current will flow through the thermally-actuated element 5 and the PTC thermistor 6.

As far as such leakage current flows, the PTC thermistor 6 continues to generate heat and keeps the thermally-actuated element 5 in the reversely warped state to greatly increase the resistance, therefore, the current does not flow through the path between the fixed contact 20 and the movable contact 41, and only the above described small leakage current flows (constituting the self-holding circuit). This leakage current can be utilized for other functions of a safety device.

The fixed piece 2 has a contacting portion 27 which contacts with the PTC thermistor 6. In this embodiment, the top portions of the projections 26*a* formed in the support portion 26 correspond to the contacting portion 27.

In an embodiment in which the projections 26*a* are not formed, the contacting portion will be an area of the support portion 26 contacting with the PTC thermistor 6. For example, when the second surface of the PTC thermistor 6 and the first surface of the support portion 26 are flat, the contacting portion is most of the first surface of the support portion 26.

Figure 4:
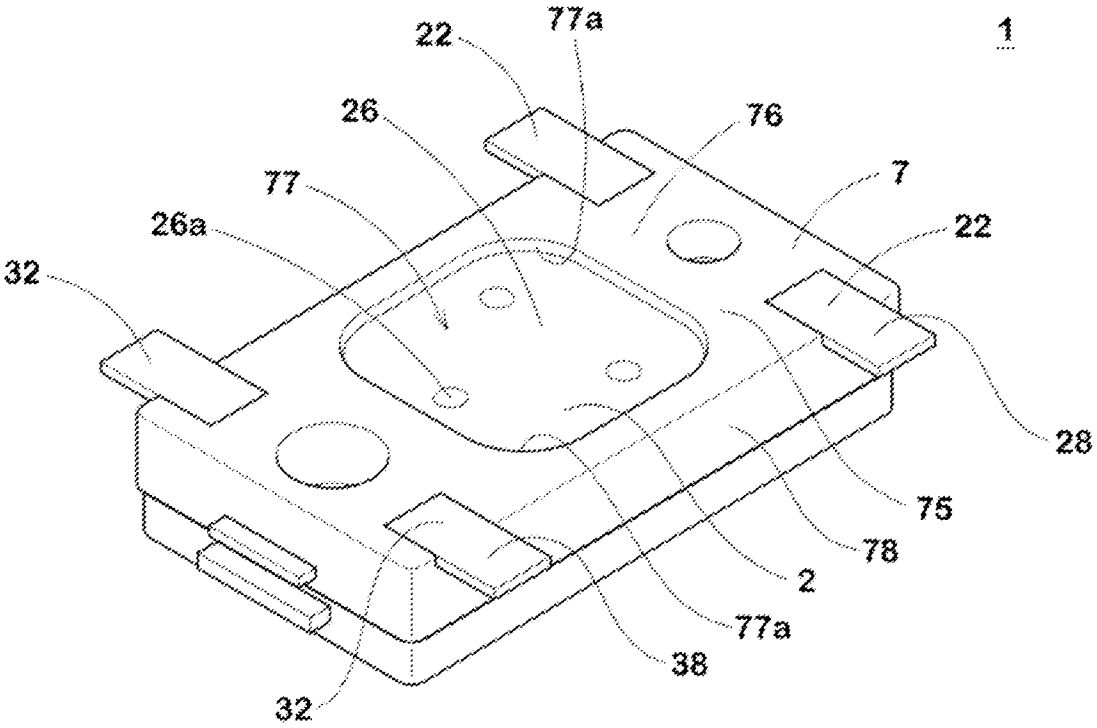
FIG. 4 A perspective view of the breaker viewed from is bottom side.
Figure 5:
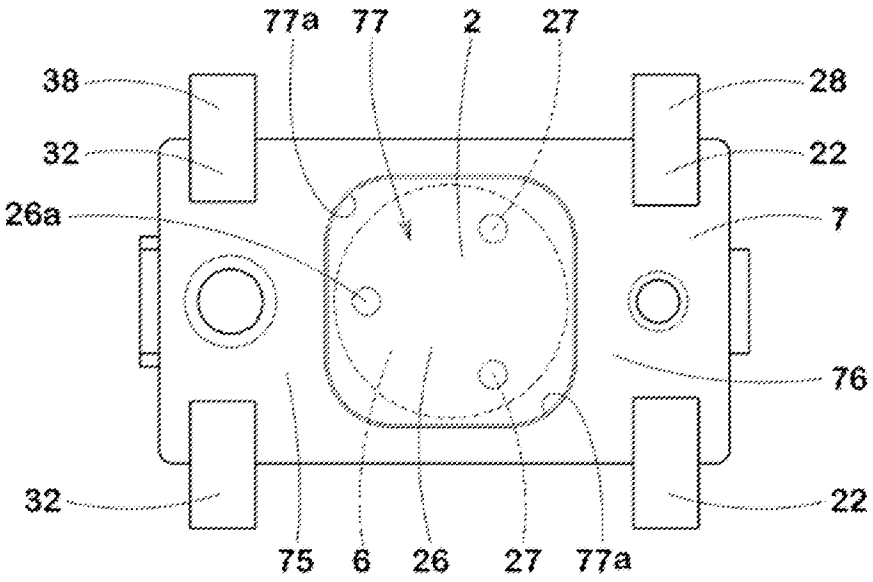
FIG. 5 A bottom view of the breaker.

FIG. 4 and FIG. 5 show the breaker 1 as viewed from the bottom side. The case main body 7 has a bottom wall 75.

The bottom wall 75 has a bottom surface 76 forming the outer bottom of the breaker 1, and a concave portion 77 recessed from the bottom surface 76 toward the PTC thermistor 6 across the fixed piece 2.

In this breaker 1, the contacting portion 27 is disposed within the concave portion 77 in a planar view when the fixed piece 2 is viewed from the PTC thermistor 6. That is, in the bottom view as shown in FIG. 5, the contacting portion 27 is disposed within the concave portion 77.

Accordingly, even when the breaker 1 is exposed to a high temperature environment, and the deformed reversely warped thermally-actuated element 5 presses the PTC thermistor 6 toward the bottom surface 76 of the case main body 7 as shown in FIG. 3, the fixed piece 2 expands outwardly (in FIG. 3 below)

in the portion where the contacting portion 27 is provided, namely, in the concave portion 77 which is recessed in advance. At this time, the bottom wall 75 which constitutes the outer periphery of the concave portion 77 can maintain its original shape as shown in FIG. 2 almost without being deformed.

Thus, the increasing in the thickness of the case 10 and thus of the breaker 1 as a whole is suppressed, and it becomes possible to easily achieve the miniaturization.

The effect to suppress the expansion of the bottom wall 75 of the case main body 7 described above is remarkably effectual in a reflow process in which the breaker 1 is exposed to high temperatures. Therefore, in the reflow process, the posture of the breaker 1 relative to the circuit board is stabilized, and the contact state between the terminals 22 and 32 of the breaker 1 and lands of the circuit board is stabilized. Thus, easily good soldering is possible.

In this breaker 1, it is desirable that the whole of the PTC thermistor 6 is disposed within the concave portion 77 in the above-said planar view. That is, it is desirable that, in the bottom view as shown in FIG. 5, the whole of the PTC thermistor 6 is disposed within the concave portion 77.

In such embodiment, a region where the PTC thermistor 6 presses the fixed piece 2 when the thermally-actuated element 5 is deformed to reversely warp, is limited, and the deformation of the fixed piece 2 is suppressed. Therefore, the plastic deformation of the case main body 7 is further suppressed.

In this breaker 1, it is desirable that the support portion 26 of the fixed piece 2 is exposed from the concave portion 77. That is, the concave portion 77 is formed by a through hole penetrating through the bottom wall 75 in the thickness direction thereof. In such embodiment, the second surface of the support portion 26 becomes the bottom surface of the concave portion 77. Therefore, the expansion of the breaker 1 due to the deformation of the fixed piece 2 is further suppressed.

Incidentally, the concave portion 77 may be formed to have a bottom by a resin. In this case, it is desirable that the height of the bottom of the concave portion 77 is set so that the bottom of the concave portion 77 does not protrude outwardly from the bottom surface of the case main body 7 when the thermally-actuated element 5 is reversely warped. According to such concave portion, it is possible to improve the sealability while suppressing the expansion of the case 10. Further, in the reflow process described above, the solder penetration into the concave portion 77 can be suppressed.

The fixed piece 2 has the terminals 22 and 32 exposed from the bottom surface 76 so as to be connected to an external circuit.

By the structure in which the terminal 22 is exposed from the bottom surface 76, it becomes possible to intensively-arrange the terminal 22. Thus, the occupy area of a land portion of an external circuit is reduced, and the degree of freedom in designing the pattern is increased.

The terminal 22 is flush with the bottom wall 75, namely, arranged on the same plane as the bottom surface 76. Thereby, it is possible to easily thin the breaker 1.

The same applies to the terminal 32.

Further, the terminals 22 and 32 are disposed in four corners of the rectangular case main body 7 in the bottom view.

Thus, in the above-mentioned reflow process, the position and posture of the breaker 1 are stabilized, and the breaker 1 can be accurately mounted on a circuit board.

Figure 8:
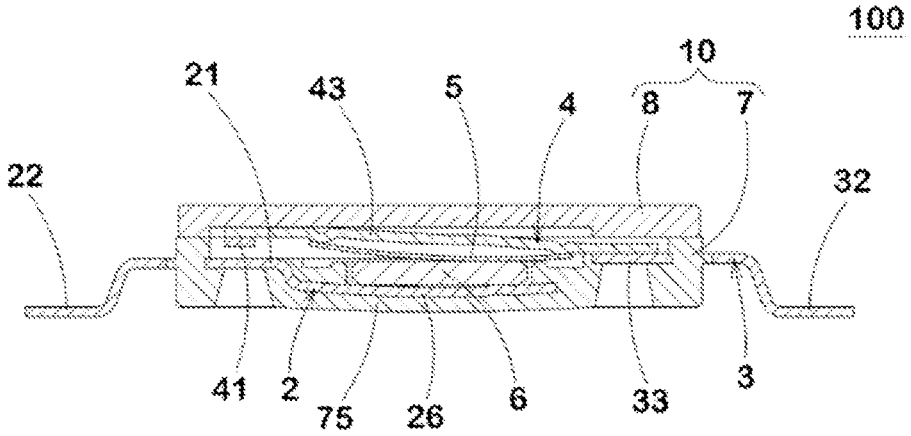
FIG. 8 A cross sectional view showing the conventional breaker.
Figure 8:
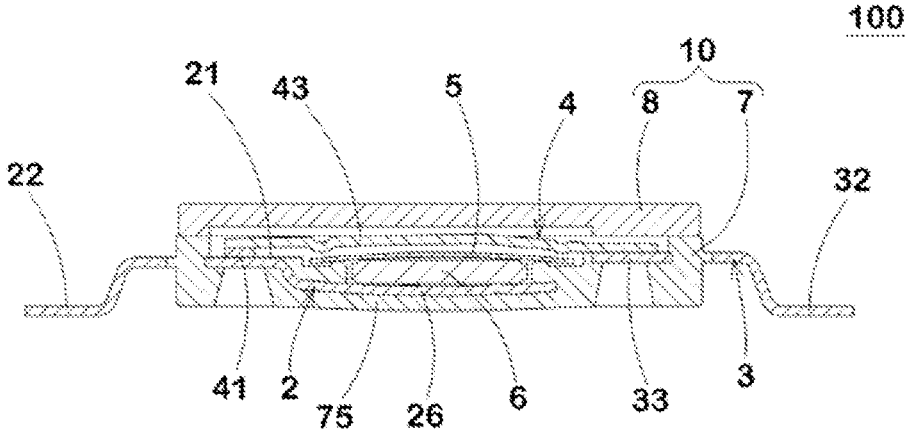

In this breaker 1, the terminals 22 and 32 are formed so as to extend in the short direction of the case main body 7. In such embodiment, it is possible to reduce the length in the long direction of the breaker 1 as compared with the breaker 100 shown in FIG. 8.

The terminals 22 and 32 have protruding portions 28 and 38 protruding from the side walls 78 on the sides of the long sides. The protruding length of the protruding portions 28 and 38 from the side wall 78 is arbitrary. For example, after bonding the lid member 8 to the case main body 7, the protruding portions 28 and 38 may be cut so as to have a length slightly protruding from the side wall 78, or so as to become flush with the side wall 78.

In this breaker 1, as shown in FIG. 4 and FIG. 5, the concave portion 77 is formed in a rectangular shape in the bottom view of the case main body 7.

The concave portion 77 has corner portions 77*a* positioned in regions facing the two pairs of the terminals 22 and 32. The corner portion 77*a* is formed in an arc shape convex toward the terminal 22, 32.

Thus, when molding the case main body 7 by inserting the fixed pieces 2 into a mold, the flow of the resin material becomes good, and the molding accuracy of the case main body 7 is increased.

Further, in the reflow process described above, the solder can be prevented from penetrating into the concave portion 77. Incidentally, the concave portion 77 may be formed in a circular or oval shape in the bottom view of the case main body 7.

Figure 6:
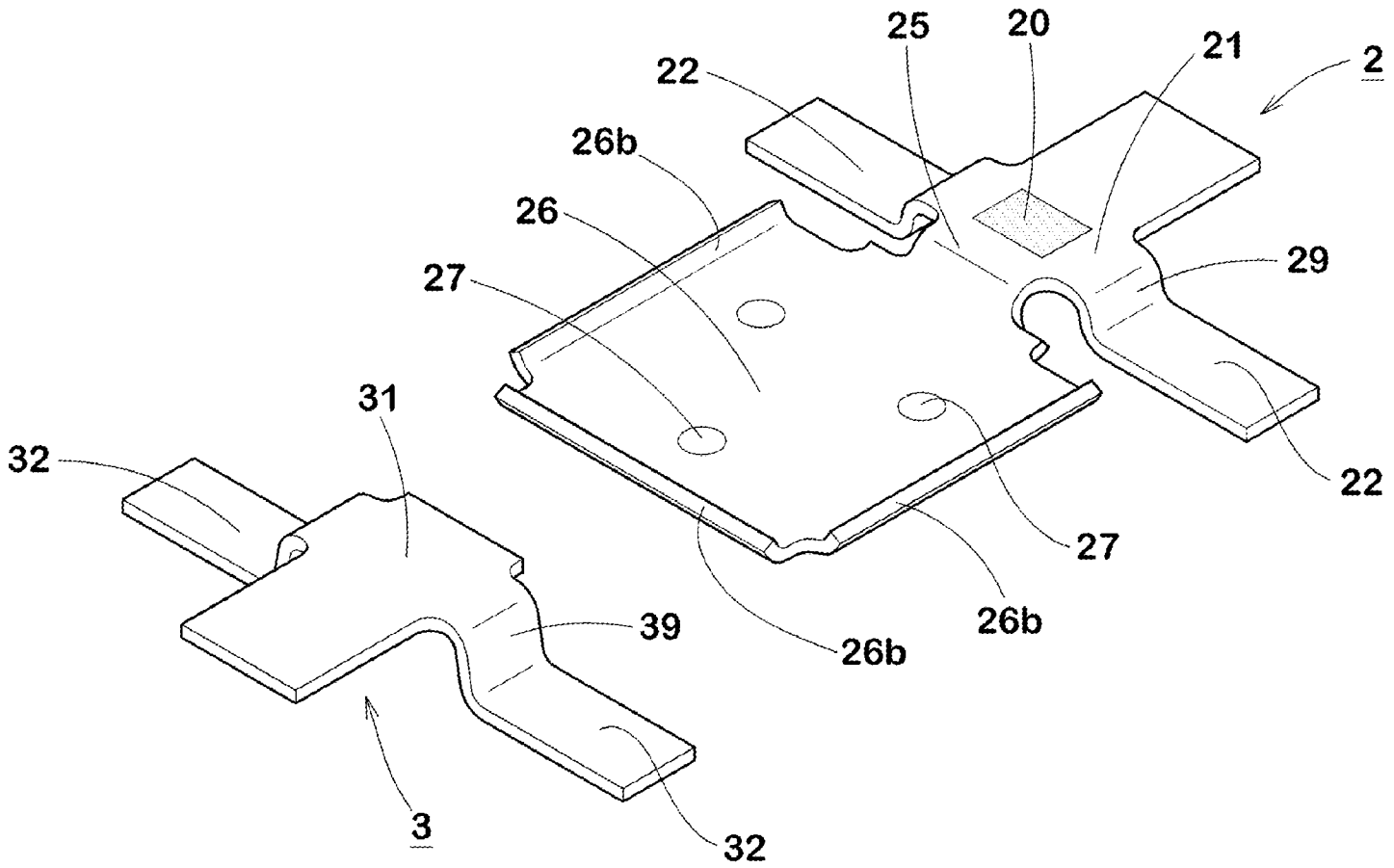
FIG. 6 Perspective views of the fixed piece and a terminal piece of the breaker.

FIG. 6 shows the fixed piece 2 and the terminal piece 3. In the fixed pieces 2, a pair of the terminals 22 is formed in the form of a wing which projects from the contact portion 21 in the short direction of the case main body 7.

Between the contact portions 21 and the terminal 22, there is formed a steppedly bent portion 29 in the form of a step. The steppedly bent portion 29 is embedded in the case main body 7. The steppedly bent portion 29 arranges the terminal 22 and the contact portion 21 at different heights.

Owing to the steppedly bent portion 29, it becomes possible to easily let the terminal 22 exposed from the bottom surface 76 of the case main body 7, while setting the height of the contact portion 21 from the bottom surface 76 in accordance with the depth of the concave portion 77 and the thickness of the PTC thermistor 6.

In the terminal piece 3, a pair of the terminals 32 is formed in the form of a wing which projects from the connecting portion 31 in the short direction of the case main body 7. Between the connecting portion 31 and the terminal 32, there is formed a steppedly bent portion 39 in the form of a step. The steppedly bent portion 39 is embedded in the case main body 7. The steppedly bent portion 39 arranges the connecting portion 31 and the terminals 32 at different heights.

Owing to the steppedly bent portion 39, it becomes possible to easily let the terminals 32 exposed from the bottom surface 76 of the case main body 7, while setting the height of the connecting portion 31 from the bottom surface 76 in accordance with the depth of the concave portion 77 and the thickness of the PTC thermistor 6.

The support portion 26 is provided, at its distal end in the long direction and both ends in the short direction, with bent portions 26*b*.

The bent portions 26*b* are formed by bending or curving the distal end portion and both end portions of the support portion 26 toward the thermally-actuated element 5.

By the bent portions 26*b* which bit into the case main body 7, the fixed piece 2 is firmly joined to the case main body 7. Further, as the support portion 26 is provided with the bent portions 26*b*, when molding the case main body 7 by inserting the fixed pieces 2 into a mold, the flow of the resin material to the peripheral region of the concave portion 77 is improved.

The breaker 1 according to the present invention is not limited to the above-described embodiments, and may be modified into various modes. In other words, only need is that the breaker 1 comprises at least a fixed piece 2 which has a fixed contact 20, a movable piece 4 which has a movable contact 41 and which presses the movable contact 41 against the fixed contact 20 to contact therewith, a thermally-actuated element 5 which deforms with a change in the temperature so as to shift the movable piece 4 from a conduction state in which the movable contact 41 contacts with the fixed contact 20 to a turn-off state in which the movable contact 41 is separated from the fixed contact 20, a PCT thermistor 6 which provides an electrical conduction between the movable piece 4 and the fixed piece 2 when the movable piece 4 is in the above-said turn-off state, and a resin case 10 which accommodates the fixed piece 2, the movable piece 4, the thermally-actuated element 5, and the PCT thermistor 6, wherein the fixed piece 2 has a contacting portion 27 contacting with the PCT thermistor 6, the resin case 10 has a bottom surface 76 and a concave portion 77 which is recessed from the bottom surface 76 toward the PCT thermistor 6 across the fixed piece 2, and in a planar view when the fixed piece 2 is viewed from the PCT thermistor 6, the contacting portion 27 is disposed within the concave portion 77.

For example, the method of bonding the case main body 7 and the lid member 8 is not limited to ultrasonic welding. Methods by which, as long as, both are firmly bonded, may be suitably applied. For example, both may be bonded by applying/filling and hardening a liquid or gel adhesive. Moreover, the case 10 is not limited to the embodiment constituted by the case main body 7, the lid member 8 and the like, and it may be composed of two or more parts.

Further, the case 10 may be sealed with resin or the like, by secondary insert molding or the like, in a state in which the terminals 22 and 32 are exposed. In this case, it is desirable that the portion corresponding to the concave portion 77 is recessed toward the PTC thermistor 6. Thereby, airtightness is further improved while suppressing the expansion of the case 10.

Further, it may be possible to employ such a structure that the movable piece 4 and the thermally-actuated element 5 are formed integrally by forming the movable piece 4 from a laminated metal such as bimetal or trimetal.

In this case, the structure of the breaker is simplified, and it is possible to achieve further miniaturization.

Furthermore, the present invention may be applied to the embodiment shown in Publication No. WO2011/105175 in which the terminal piece 3 and the movable piece 4 are integrally formed.

Further, the breaker 1 according to the present invention can be widely applied to a secondary battery pack, a safety circuit for an electrical equipment and the like.

Figure 7:
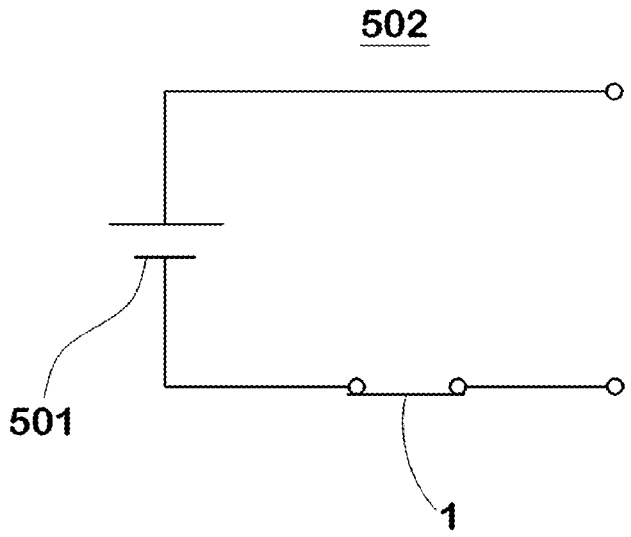
FIG. 7 A circuit diagram of a safety circuit equipped with the breaker according to the present invention.

FIG. 7 shows a safety circuit 502 of an electrical equipment. The safety circuit 502 has the breaker 1 in series in an output circuit of a secondary battery 501.

Furthermore, the breaker 1 according to the present invention can be applied to the connector disclosed in Japanese Patent Application Publication No. 2016-225142, for example.

In this case, it is possible to readily reduce the size of the connector. Further, a part of the safety circuit 502 may be constituted by a cable including the connector provided with the breaker 1.

EXPLANATION OF SIGNS

1: breaker
2: fixed piece
4: movable piece
5: thermally-actuated element
6: PTC thermistor (positive temperature coefficient thermistor)
10: case
20: fixed contact
27: contacting portion
41: movable contact
76: bottom surface
77: concave portion
77*a*: corners
502: safety circuit

The invention claimed is:

1. A breaker comprising:

a fixed piece which has a fixed contact, a movable piece which has a movable contact and which presses the movable contact against the fixed contact to make contact therewith, a thermally-actuated element which deforms with a change in temperature so as to shift the movable piece from a conduction state in which the movable contact contacts the fixed contact to a turn-off state in which the movable contact is separated from the fixed contact, a positive temperature coefficient thermistor which provides an electrical conduction between the movable piece and the fixed piece when the movable piece is in said turn-off state, and a resin case which accommodates the fixed piece, the movable piece, the thermally-actuated element and the positive temperature coefficient thermistor, wherein:

the fixed piece has a support portion for supporting the positive temperature coefficient thermistor, the support portion comprises a plurality of protruding contacting portions contacting the positive temperature coefficient thermistor, the resin case has a bottom surface provided with a concave portion which is concaved toward the positive temperature coefficient thermistor across the fixed piece, and in a planar view when the fixed piece is viewed from the positive temperature coefficient thermistor, said plurality of protruding contacting portions are each disposed within the concave portion, the concave portion has a bottom which is recessed from the bottom surface of the resin case so as to prevent the bottom of the concave portion from protruding outwardly from the bottom surface of the resin case when the thermally-actuated element is deformed and presses the positive temperature coefficient thermistor, and the positive temperature coefficient thermistor presses the plurality of protruding contacting portions toward the bottom surface of the resin case, and between the bottom of the concave portion and the bottom surface of the resin case, a step is formed so as to extend over the substantially entire circumference of the concave portion, the bottom of the concave portion is formed by a surface of the fixed piece which is on an opposite side of the plurality of protruding contacting portions of the support portion and which is exposed from the concave portion, the bottom surface of the resin case is provided with a terminal piece comprising terminals configured to be connected to an external circuit so as to be exposed from the bottom surface of the resin case, and the concave portion is provided, in vicinities of the terminals, with arc-shaped portions which are convex toward respective terminals.

2. The breaker as set forth in claim 1, wherein in said planar view, the entire positive temperature coefficient thermistor is disposed within the concave portion.

3. A safety circuit which is for an electrical equipment and which is characterized by having the breaker as set forth in claim 1.

4. The breaker as set forth in claim 1, wherein in said planar view, the concave portion is formed in a substantially rectangular shape, and has four rounded corners as said arc-shaped portions.

5. The breaker as set forth in claim 1, wherein the bottom of the concave portion is recessed from the bottom surface of the resin case in the conduction state as well as even in the turn-off state in which the thermally-actuated element is deformed and presses the positive temperature coefficient thermistor, and the pressed positive temperature coefficient thermistor presses the plurality of protruding contacting portions of the fixed piece toward the bottom surface of the resin case, and thereby the fixed piece is deformed toward the bottom surface of the resin case.

6. The breaker as set forth in claim 1, wherein in said planar view, the concave portion is formed in a circular shape.

7. The breaker as set forth in claim 1, wherein in said planar view, the concave portion is formed in an oval shape.

8. The breaker as set forth in claim 1, wherein said plurality of protruding contacting portions respectively form second concave portions on opposite sides of the plurality of protruding contacting portions in respective protruding directions of the plurality of protruding contacting portions, and the second concave portions are recessed from the bottom of the concave portion of the bottom surface of the resin case within the concave portion.

9. The breaker as set forth in claim 8, wherein the bottom surface of the resin case forms a bottom surface of the breaker, and the bottom surface of the breaker has a concave portion formed by the concave portion of the bottom surface of the resin case.

10. The breaker as set forth in claim 9, wherein said terminals have surfaces which are exposed and substantially flush with the bottom surface of the breaker.

11. A breaker comprising:

a fixed piece which has a fixed contact, a movable piece which has a movable contact and which presses the movable contact against the fixed contact to make contact therewith, a thermally-actuated element which deforms with a change in temperature so as to shift the movable piece from a conduction state in which the movable contact contacts the fixed contact to a turn-off state in which the movable contact is separated from the fixed contact, a positive temperature coefficient thermistor which provides an electrical conduction between the movable piece and the fixed piece when the movable piece is in the turn-off state, and a resin case which accommodates the fixed piece, the movable piece, the thermally-actuated element and the positive temperature coefficient thermistor, wherein:

the fixed piece has a support portion for supporting the positive temperature coefficient thermistor, the support portion comprises a plurality of protruding contacting portions contacting the positive temperature coefficient thermistor, the resin case has a bottom surface provided with a concave portion which is concaved toward the positive temperature coefficient thermistor, and in a planar view when the fixed piece is viewed from the positive temperature coefficient thermistor, said plurality of protruding contacting portions are each disposed within the concave portion, the concave portion has a bottom which is recessed from the bottom surface of the resin case so as to prevent the bottom of the concave portion from protruding outwardly from the bottom surface of the resin case when the thermally-actuated element is deformed and presses the positive temperature coefficient thermistor, and the positive temperature coefficient thermistor presses the plurality of protruding contacting portions toward the bottom surface of the resin case, and between the bottom of the concave portion and the bottom surface of the resin case, a step is formed so as to extend over the substantially entire circumference of the concave portion, the bottom of the concave portion is formed by a resin, the bottom surface of a terminal piece comprising terminals configured to be connected to an external circuit so as to be exposed from the bottom surface of the resin case, and the concave portion is provided, in vicinities of the terminals, with arc-shaped portions which are convex toward respective terminals.

12. The breaker as set forth in claim 11, wherein in said planar view the entire positive temperature coefficient thermistor is disposed within the concave portion.

13. A safety circuit which is for an electrical equipment and which is characterized by having the breaker as set forth in claim 11.

14. The breaker as set forth in claim 11, wherein in said planar view, the concave portion is formed in a substantially rectangular shape, and has four rounded corners as said arc-shaped portions.

15. The breaker as set forth in claim 11, wherein the bottom of the concave portion is recessed from the bottom surface of the resin case in the conduction state as well as even in the turn-off state in which the thermally-actuated element is deformed and presses the positive temperature coefficient thermistor, and the pressed positive temperature coefficient thermistor presses the plurality of protruding contacting portions of the fixed piece toward the bottom surface of the resin case, and thereby the fixed piece is deformed toward the bottom surface of the resin case.

16. The breaker as set forth in claim 11, wherein in said planar view, the concave portion is formed in a circular shape.

17. The breaker as set forth in claim 11, wherein in said planar view, the concave portion is formed in an oval shape.

18. The breaker as set forth in claim 11, wherein said plurality of protruding contacting portions respectively form second concave portions on opposite sides of the plurality of protruding contacting portions in respective protruding directions of the plurality of protruding contacting portions, and the second concave portions are recessed from the bottom of the concave portion of the bottom surface of the resin case within the concave portion.

19. The breaker as set forth in claim 18, wherein the bottom surface of the resin case forms a bottom surface of the breaker, and the bottom surface of the breaker has a concave portion formed by the concave portion of the bottom surface of the resin case.

20. The breaker as set forth in claim 19, wherein said terminals have surfaces which are exposed and substantially flush with the bottom surface of the breaker.

* * * * *